US006170557B1

(12) United States Patent
Ching-Fu et al.

(10) Patent No.: US 6,170,557 B1
(45) Date of Patent: Jan. 9, 2001

(54) MACHINE FOR TESTING AUTOMATICALLY PERFORMANCES OF GREEN SAND MOLDING

(75) Inventors: Lin Ching-Fu; Hung Chuan-Cheng; Tseng Chien-Ming, all of Kaohsiung; Chang Chao-Chi, Fong Shan; Ou Yu-Jen; Kang Chin-Hsing, both of Kaohsiung, all of (TW)

(73) Assignee: Metal Industries Research & Development Centre, Kaohsiung (TW)

( * ) Notice: Under 35 U.S.C. 154(b), the term of this patent shall be extended for 0 days.

(21) Appl. No.: 09/249,512

(22) Filed: Feb. 12, 1999

(51) Int. Cl.[7] ..... B22C 19/04
(52) U.S. Cl. ..... 164/151; 164/456
(58) Field of Search ..... 164/456, 151, 164/155.3, 192, 193, 203

(56) References Cited

U.S. PATENT DOCUMENTS 3,638,478 * 2/1972 Dietert et al. ..... 73/73
4,784,206 * 11/1988 Sauerman et al. ..... 164/18
4,819,711 * 4/1989 Chancellor ..... 164/456
5,736,632 * 4/1998 Nishida et al. ..... 73/38

FOREIGN PATENT DOCUMENTS

2151960 * 7/1985 (GB) .
2152414 * 7/1985 (GB) .

* cited by examiner

*Primary Examiner*—Harold Pyon
*Assistant Examiner*—Len Tran
(74) *Attorney, Agent, or Firm*—W. Wayne Liauh

(57) ABSTRACT

An automatic machine is designed to test performances of green sand molding and composed of a machine support, a feeding device, a vibration device, a testing device, a detecting device, and a catching device. The green sand is extracted by the feeding device and then screened in the vibration device The selected green sand is received and carried by a test piece sleeve of the catching device. The test piece sleeve is driven to move to the testing device for testing the compatibility of the green sand, to the detecting device for testing the permeability of the green sand, and to the loadcell for testing the green compressive strength of the green sand.

6 Claims, 8 Drawing Sheets

MACHINE FOR TESTING AUTOMATICALLY PERFORMANCES OF GREEN SAND MOLDING

FIELD OF THE INVENTION

The present invention relates generally to an automatic testing machine, and more particularly to an automatic machine for testing the performances of the green sand molding.

BACKGROUND OF THE INVENTION

According to the general practice of the casting industry, the test items of the testing of the green sand performance consist mainly of compactibility, permeability, green compressive strength, etc. The conventional green sand performance testing equipments are operated manually such that only one performance test is possible in one operation, and that each test result is recorded manually. It is therefore readily apparent that the conventional machines for testing the green sand performances are inefficient at best. Generally speaking, the conventional machines described above have the shortcomings, which are described hereinafter.

The manual operation of the conventional green sand performance testing machines is prone to human error. Similarly, the manual recording of the test results is bound to result in the incorrect data. As a result, it is often difficult to secure the green sand of high quality for use in the casting. Accordingly, the rejection rate of the cast product is bound to be high.

The manual operation of the conventional machines for testing the green sand performances is rather time—consuming such that one performance test takes about 30 minutes to complete. The manual recording of the test results calls for additional worker, thereby resulting in an increase in the labor cost.

The conventional machines for testing the green sand performances are designed for testing only one performance. As a result, the operators are required to allocate additional capital expenditure for the purchase and the operation of extra machines.

SUMMARY OF THE INVENTION

The primary objective of the present invention is therefore to provide an automatic machine for testing the green sand performances in a cost-effective manner.

In keeping with the principle of the present invention, the foregoing objective of the present invention is attained by a machine designed for automatic testing of the performances of the green sand molding. The automatic machine of the present invention consists of a machine support, a feeding device, a vibration device, a testing device, a detecting device, and a catching device. The feeding device has means for extracting and transporting the green sand, and a funnel located under the transporting means. The green sand is thus transported to the vibration device via the funnel. The green sand is screened in the vibration device such that the selected sand is sent to the catching device, which has a guide slide seat capable of sliding in the bottom of the machine support. The guide slide seat is located over the loading meter. The catching device further has a test piece sleeve of a hollow construction and capable of sliding on the guide slide seat. The test piece sleeve catches the green sand which is sent out by the vibration device. In conjunction with the sliding motion of the guide slide seat, the test piece sleeve is put through the testing device and the detecting device for testing the compactibility and the permeability. The guide slide seat is provided with a discharge port through which the green sand carried by the test piece sleeve is dropped on the loading meter for carrying out the performance test of green compressive strength. The test of various performances of the green sand is automatically done in about one minute. The green sand of high quality is selected efficiently for use in the casting, so as to reduce the rejection rate of the cast product.

The foregoing objective, features, functions, and advantages of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
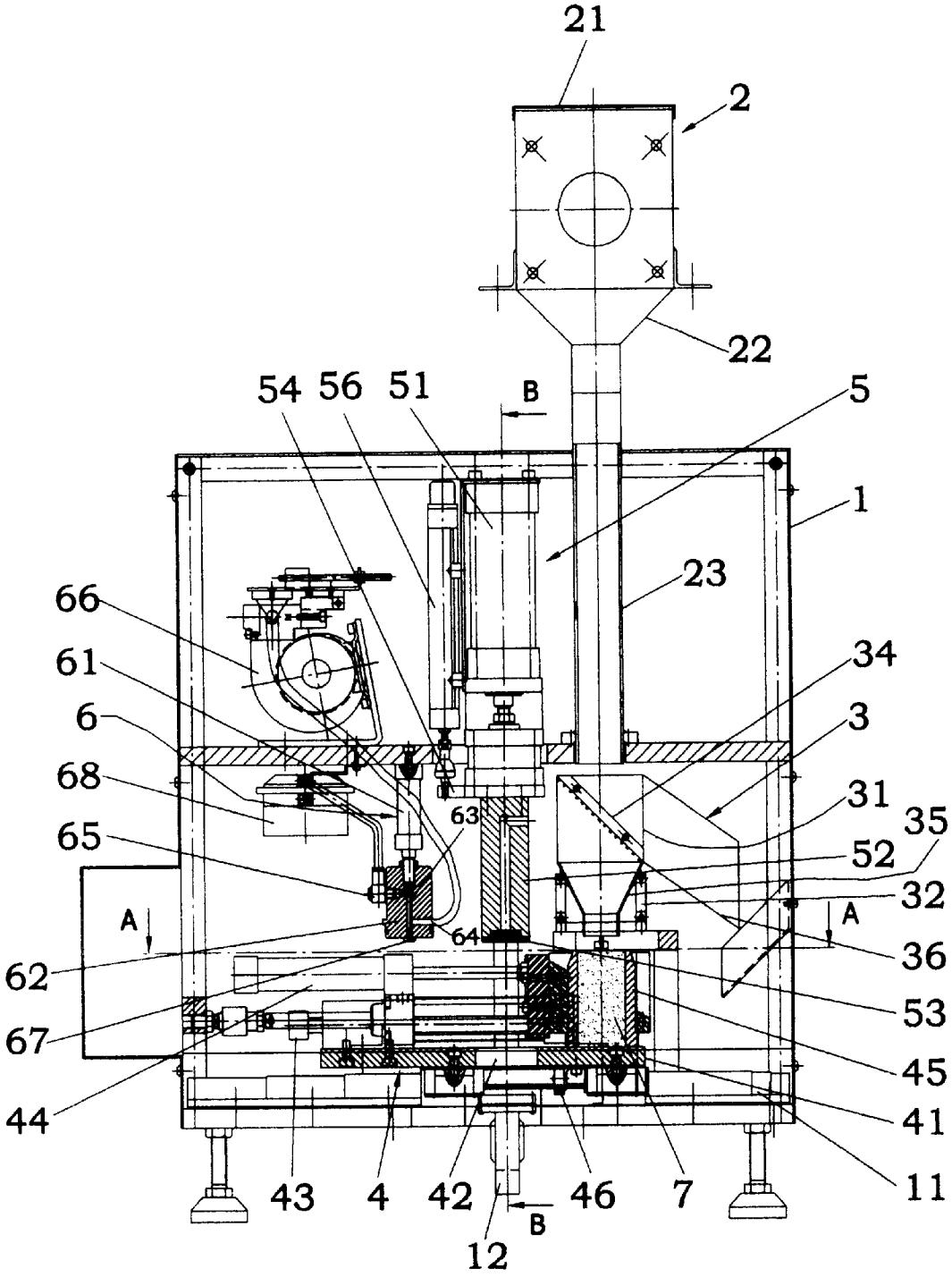
FIG. 1 shows a front view of the preferred embodiment of the present invention.
Figure 2:
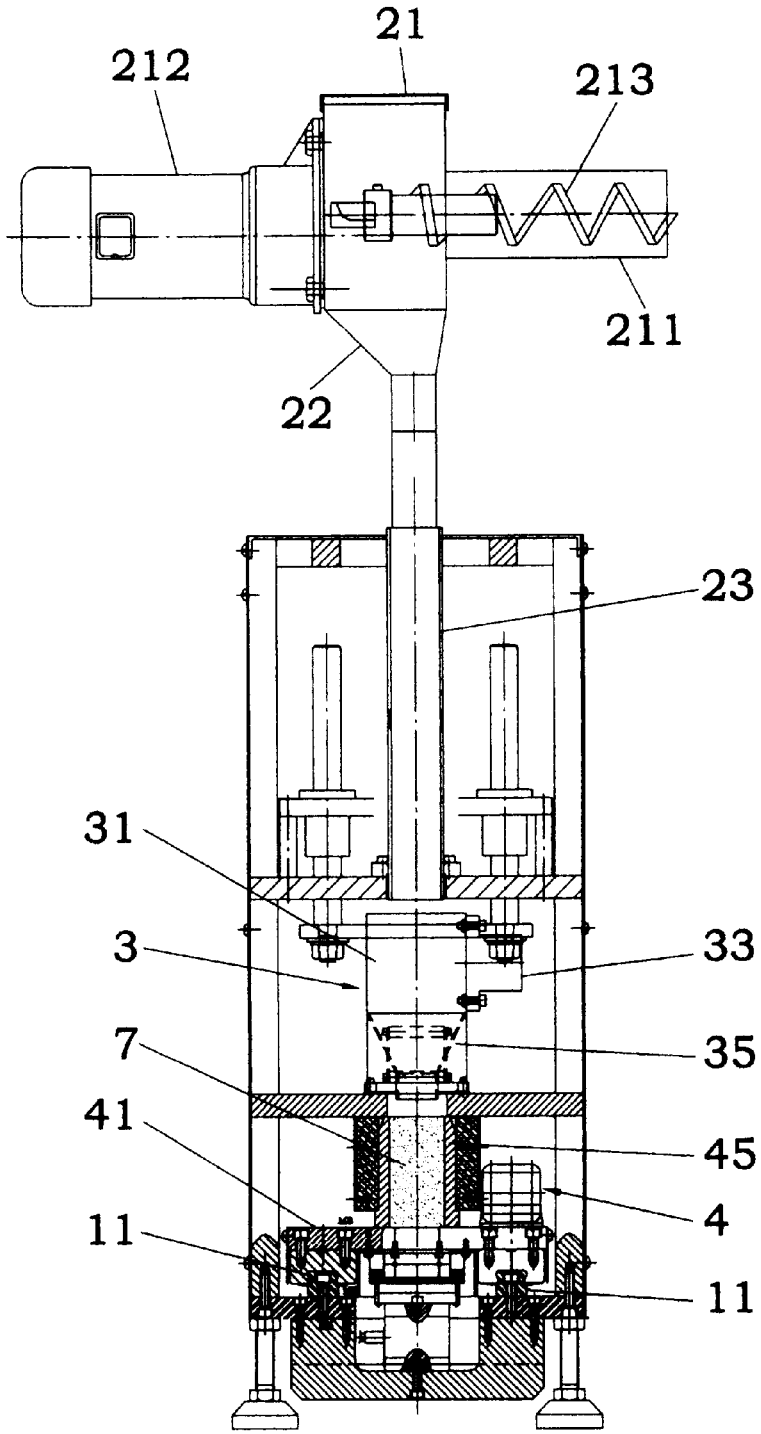
FIG. 2 shows a side view of the preferred embodiment of the present invention.
Figure 3:
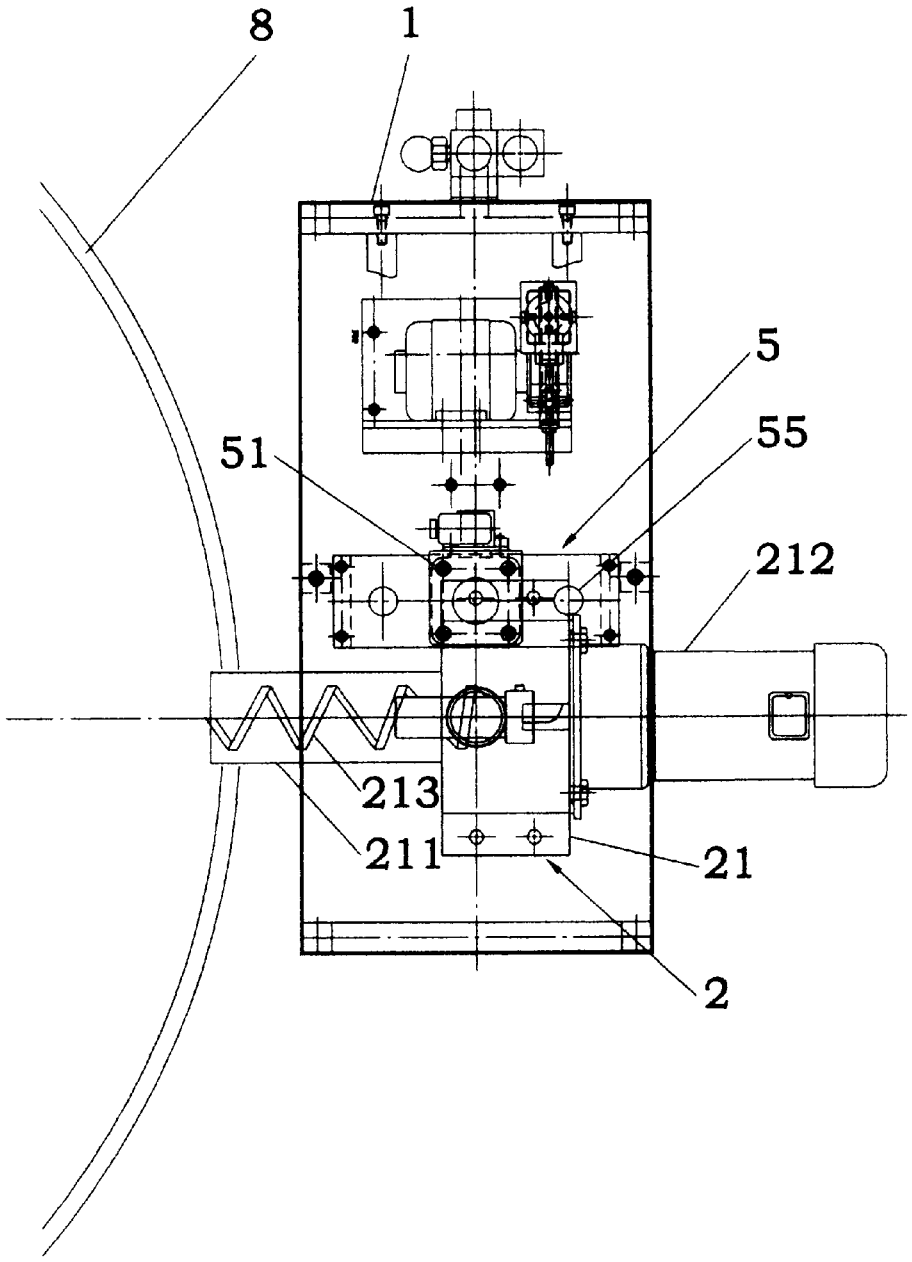
FIG. 3 shows a top view of the preferred embodiment of the present invention.

As shown in FIGS. 1, 2, and 3, a machine embodied in the present invention is designed for testing automatically the performances of green sand molding and is composed of a machine support 1, a feeding device 2, a vibration device 3, a catching device 4, a testing device 5, and a detecting device 6. The feeding device 2 is mounted on the machine support 1 and provided with a transporting apparatus 21 capable of extracting the molding sand 7. The transporting apparatus 21 has a connection pipe 211 which is connected with the tank of a sand mixing machine 8.

Figure 4:
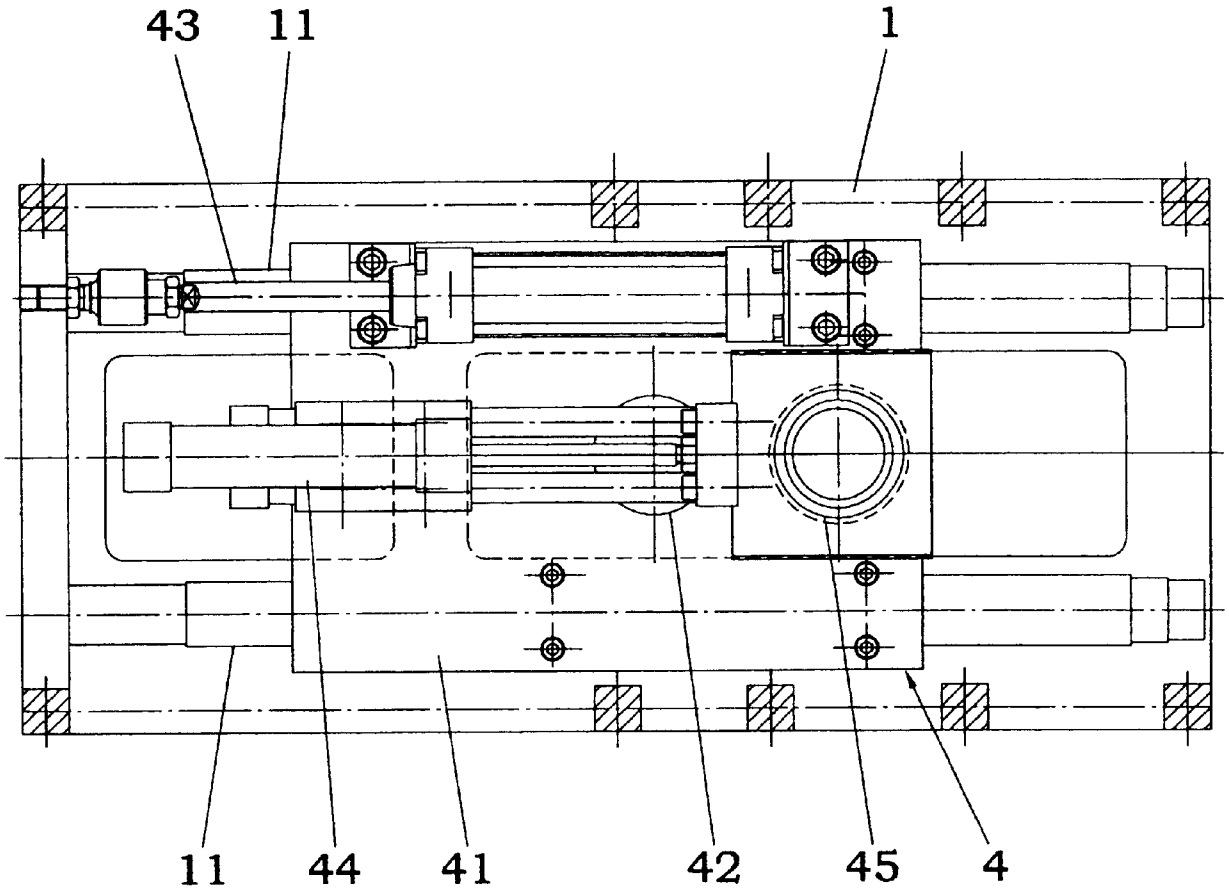
FIG. 4 shows a sectional view of a portion taken along the direction indicated by a line A—A as shown in FIG. 1.
Figure 5:
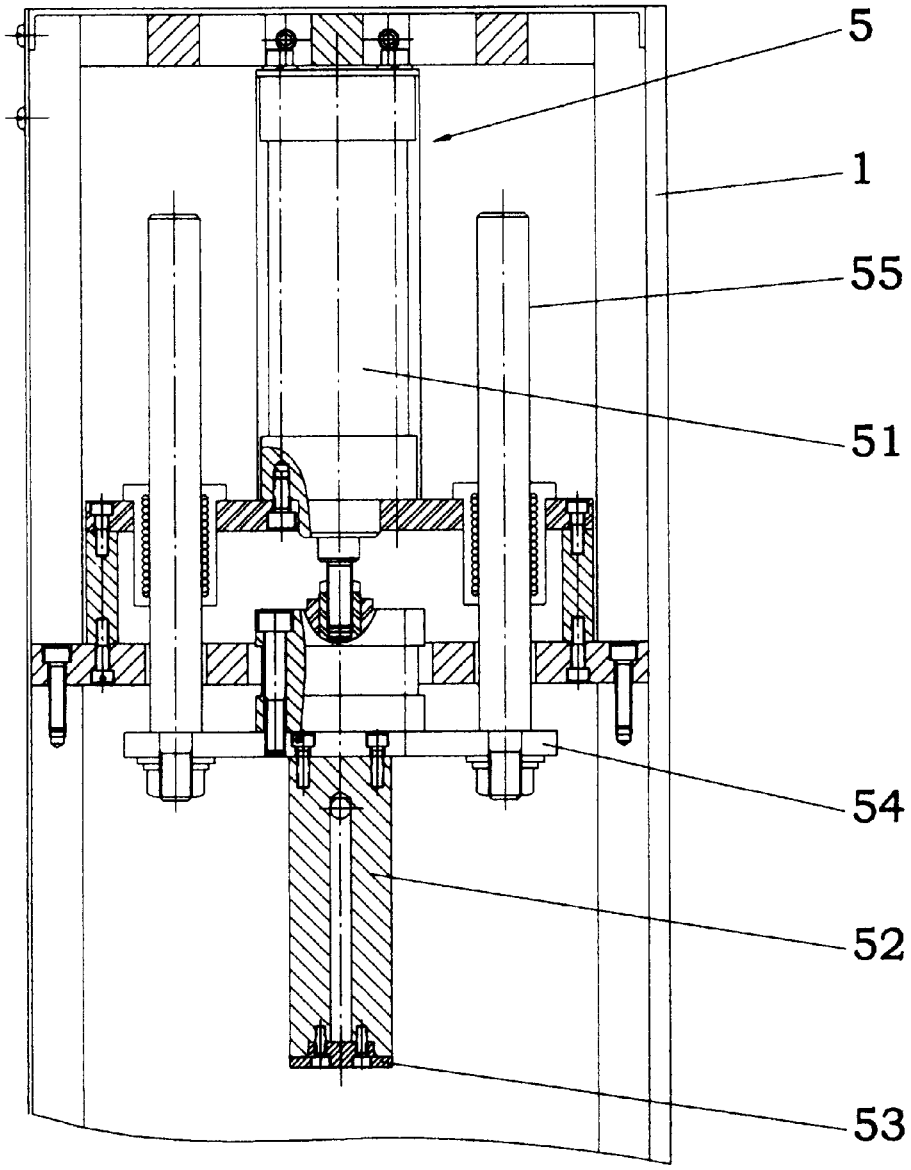
FIG. 5 shows a sectional view of a portion taken along the direction indicated by a line B—B as shown in FIG. 1.

The transporting apparatus 21 further has a motor 212 and a pushing piece 213 which is of a spiral construction and is driven by the motor 212 for extracting the molding sand 7 from the sand mixing machine 8 into the transporting apparatus 21. The green sand 7 is then sent to the vibration device 3 via a funnel 22 and a green sand pipe 23. The vibration device 3 has a seat 31 which is mounted on the machine support 1 by a silicon—steel piece 32. The vibration device 3 is provided in the outer side thereof with a pneumatic vibrator 33 for accelerating the vibrational motion of the seat 31 of the vibration device 3. The seat 31 is provided with a screen 34 for selecting the green sand. The selected green sand is received by the funnel 35. The rejected green sand is removed by an inclined plate 36 of the seat 31. The selected green sand is caught by the catching device 4 via the funnel 35 of the vibration device 3. Now referring to FIGS. 1, 2, and 4, the catching device 4 is shown to have a guide slide seat 41 which is capable of sliding on a guide rail 11 located at the bottom of the machine support 1. The guide slide seat 41 is located over a loading meter 12 and is provided with a discharging port 42 and a scratching plate 46. The guide slide seat 41 is driven by a cylinder 43 to slide along the guide rail 11. The guide slide seat 41 is provided with a cylinder 44 which is fastened therewith and is provided with an expandable rod which is in turn connected with a test piece sleeve 45 of a hollow construction such that the test piece sleeve 45 is driven to slide on the guide slide seat 41. The guide slide seat 41, the cylinder 44 and the test piece sleeve 45 can be driven by the cylinder 43 to move. The test piece sleeve 45 is driven alone by the cylinder 44. Now referring to FIGS. 1, 3, and 5, the testing device 5 has a cylinder 51 which is mounted securely on the machine support 1 and is connected with an action rod 52 which is provided with a test head 53. The action rod 52 is driven by the pressure cylinder 51 to ascend or descend. The action rod 52 is provided with a locating plate 54 and mounted on two slide rods 55 such that the action rod 52 slides stably and smoothly under the guidance of the two slide rods 55. The cylinder 51 is provided in one side thereof with a displacement sensor 56 for measuring the displacement quantity of the action rod 52. As shown in FIG. 1, the detecting device 6 of the present invention is mounted on the machine support 1 by a cylinder 61 which is connected with an air admitting seat 62. The air admitting seat 62 is provided with a passage 63 in communication with an end port 67, an air outlet 64, and an air outlet 65. The air outlet 64. is connected with a gas supplier 66 for suppling the steady-pressure gas to the air admitting seat 62 such that the gas is let out by the end port 67 and the air outlet 65 via the passage 63. The air outlet 65 is connected with a micropressure sensor 68 for detecting the change in pressure of the gas that is let out from the end port 67

Figure 6:
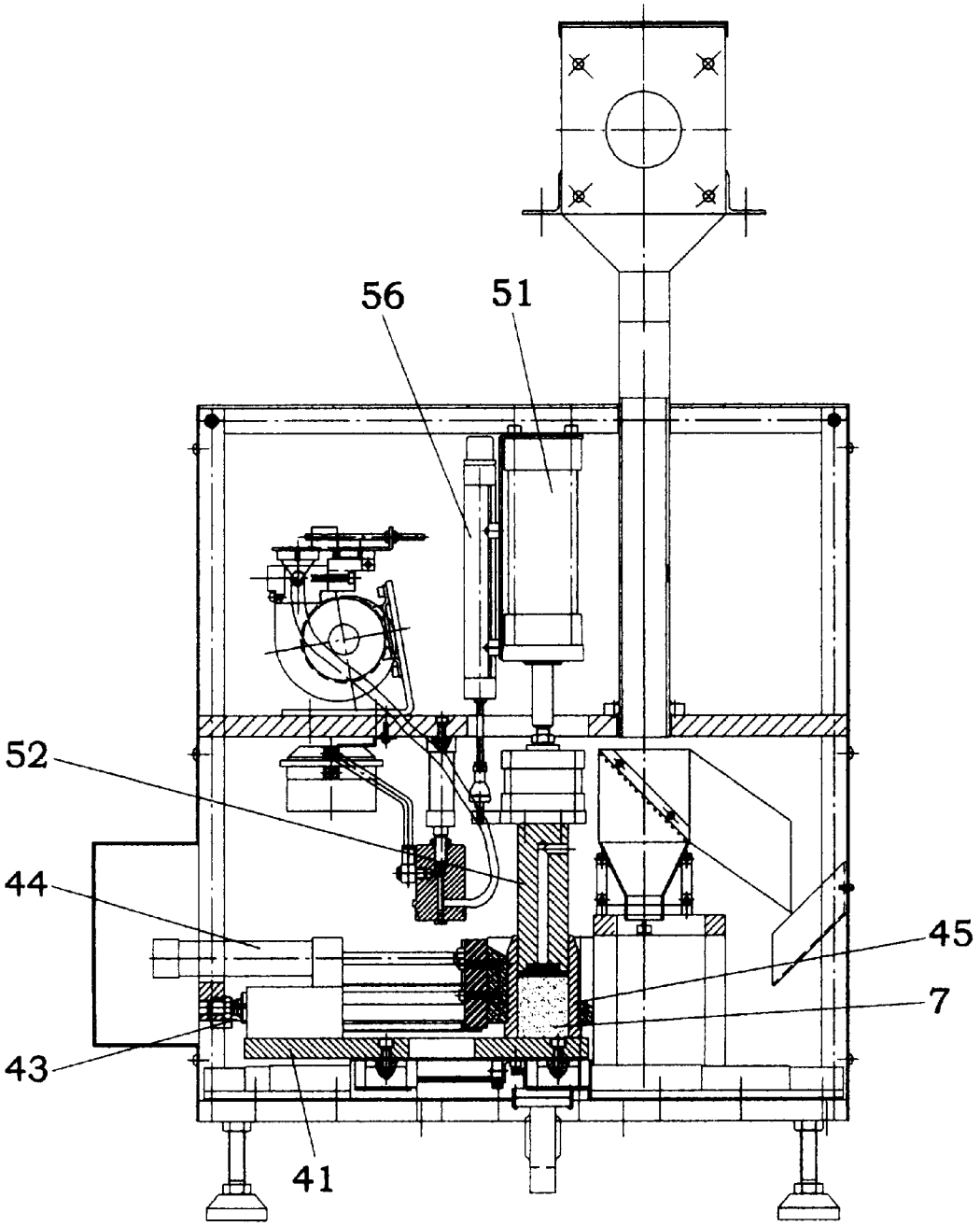
FIG. 6 shows a schematic view of the preferred embodiment of the present invention at work.
Figure 7:
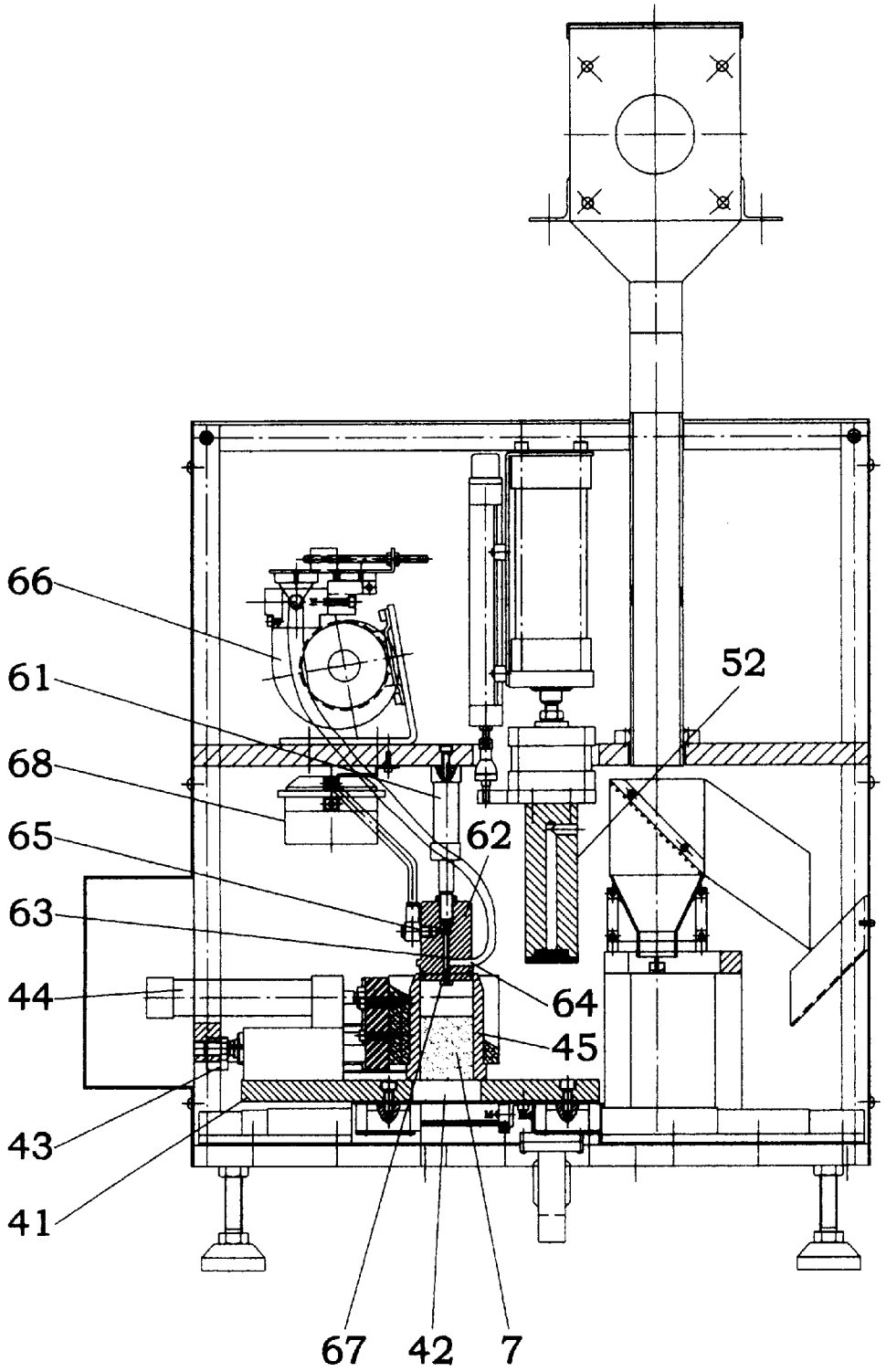
FIG. 7 shows another schematic view of the preferred embodiment of the present invention at work.
Figure 8:
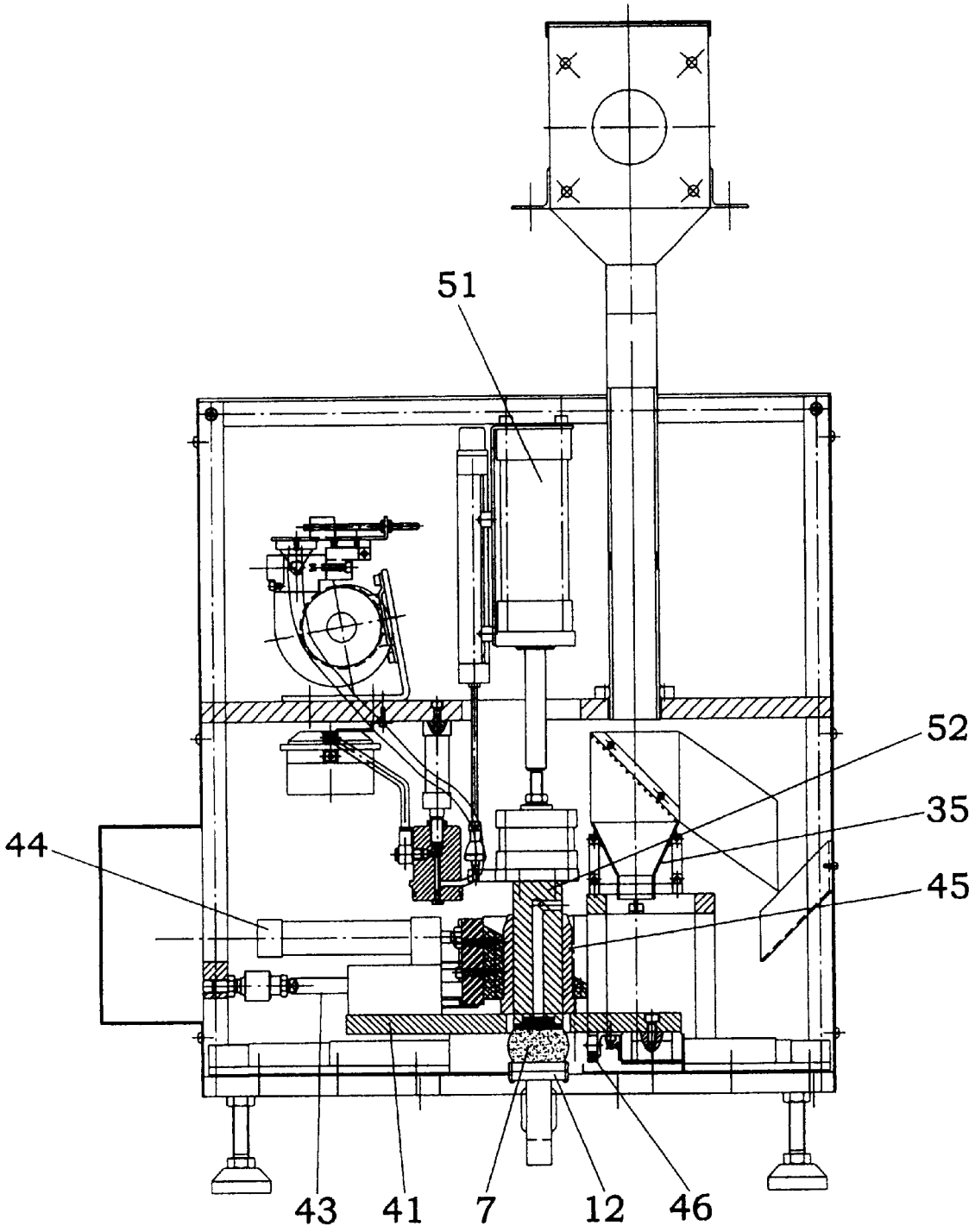
FIG. 8 shows still another schematic view of the preferred embodiment of the present invention at work.

In operation, the green sand to be tested is sent by the feeding device 2 to the vibration device 3 in which the screening of the green sand is effected. The selected green sand 7 is held in the funnel 35. In the meantime, the guide slide seat 41 of the catching device 4 is driven by the cylinder 43 to actuate the test piece sleeve 45 to move to locate under the funnel 35 so as to receive the molding sand 7 until the test piece sleeve 45 is full of the green sand 7. The lower side of the test piece sleeve 45 is blocked by the guide slide seat 41 so as to enable the test piece sleeve 45 to be full of the green sand 7. Thereafter, both the guide slide seat 41 and the test piece sleeve 45 are driven by the cylinder 43 to move away from the funnel 35 to the testing device 5. Now referring to FIG. 6, as the test piece sleeve 45 is moved to located under the action rod 52 of the testing device 5, the action rod 52 is driven by the cylinder 51 to descend to compress the green sand 7 carried in the test piece sleeve 45 whose lower side is blocked by the guide slide seat 41. In the meantime, the displacement quantity of the action rod 52 is measured by the displacement sensor 56 such that the compression ratio of the green sand 7 is attained. Upon compactibility of the test, the action rod 52 ascends. As shown in FIG. 1, the cylinder 44 is then activated to actuate the test piece sleeve 45 to move along the guide slide seat 41 to locate over the discharging port 42. In light of the green sand 7 being compressed by the action rod 52, the green sand 7 is kept in the test piece sleeve 45 without falling out of the test piece sleeve 45 to the discharging port 42. When the cylinder 61 drives the air admitting seat 62 to descend to urge the top edge of the test piece sleeve 45, the air admitting port 64 is supplied with gas by the gas supplier 66. The gas moves via the passage 63 from the end port 67 to permeate the green sand 7 kept in the test piece sleeve 45. The gas, which is obstructed by the green sand 7, is discharged via the air outlet 65 to the micropressure sensor 68 for computing the pressure difference of the air inlet 64 and the air outlet 65. As a result, the permeability of the green sand 7 is attained. Upon completion of the permeability test, the air admitting seat 62 ascends once again. In the meantime, the cylinder 43 is activated to drive the guide slide seat 41 and the test piece sleeve 45 to move such that the test piece sleeve 45 is once again located under the action rod 52, as shown is FIG. 8. The action rod 52 is driven by the cylinder 51 to descend such that the action rod 52 is extended into the sleeve 45 to force the green sand 7 out of the sleeve 45. The lower side of the green sand 7 is pressed against by the loading meter 12 while the action rod 52 continues to extend until the green sand 7 is cracked. The green compressive strength of the green sand 7 is thus measured by the loadcell meter 12. It is therefore readily apparent that the machine of the present invention is capable of testing the compactibility, the gas permeability and the green compressive strength of the green sand with precision and speed. As all tests are completed, the guide slide seat 41 returns to its original position that is located under the funnel 35, as shown in FIG. 1. When the guide slide seat 41 moves back to its original position, the green sand 7 is removed by the scratching plate 46 from the loadcell 12 so as to ensure the reliability of the subsequent testing of the green compressive strength of the green sand.

The present invention is efficient and automatic such that the test data can be stored in the computer for future reference, and that the quality control of the green sand is so enhanced as to reduce the rejection rate of the cast products.

The automatic machine of the present invention is capable of testing the compatibility, the permeability and the green compressive strength of the molding sand in one minute. The present invention can be thus incorporated into the production line of the green sand mixing.

The machine of the present invention is relatively simple in construction. In addition, the volume and the weight of the present invention are substantially reduced as compared with the prior art machines. The present invention is therefore cost effective.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An automatic machine for testing performances of green sand molding, said machine comprising:

a machine support having a bottom portion;

a feeding device mounted on said machine support and provided with a transporting apparatus for extracting the green sand, and a funnel located under said transporting apparatus;

a vibration device mounted on said machine support and provided with a seat for receiving the green sand from said funnel, said seat provided with a screen for selecting the green sand and a vibrator for providing a power source for selecting the green sand, said seat further provided thereunder with a funnel for separating the green sand, and an inclined plate for removing the green sand;

a catching device having a guide slide seat slidable in the bottom of said machine support and located over a loadcell meter, said catching device further having a test piece sleeve of a hollow construction and slidable on said guide slide seat, said test piece sleeve intended to receive the green sand from said funnel located under said vibration device, said guide slide seat provided with a discharging port;

a testing device having an action rod and a displacement sensor, said action rod being driven by a cylinder to ascend or descend and provided with a test head, said action rod being opposite in location to said loadcell which is mounted on the bottom of said machine support; and a detecting device having a cylinder which is fastened with said machine support and is provided with an air admitting seat corresponding in location to said test piece sleeve and having a passage attached to an end port, said passage provided with an air inlet and an air outlet, with said air inlet being connected with a gas supplier, and with said air outlet being connected with a micropressure sensor.

2. The automatic machine as defined in claim 1, wherein said transporting apparatus of said feeding device is a spiral transporting apparatus or vibrational transporting apparatus.

3. The automatic machine as defined in claim 1, wherein said guide slide seat of said catching device is connected with a cylinder which is fastened at one end thereof with said machine support and at other end thereof with said guide slide seat, said guide slide seat being driven by said cylinder to slide.

4. The automatic machine as defined in claim 1, wherein said guide slide seat of said catching device is fastened with a cylinder having an expandable rod which is connected with said test piece sleeve for driving said test piece sleeve to slide along said guide slide seat.

5. The automatic machine as defined in claim 1, wherein said bottom portion of said machine support is provided with a guide rail; and wherein said guide slide seat slides along said guide rail.

6. The automatic machine as defined in claim 1, wherein said guide slide seat of said catching device is provided in the bottom thereof with a sand removing plate for removing the green sand from said loading meter at the time when said guide slide seat is driven to slide.

* * * * *